US007362992B2

(12) United States Patent
Nakasone et al.

(10) Patent No.: US 7,362,992 B2
(45) Date of Patent: Apr. 22, 2008

(54) DEVELOPING UNIT AND IMAGE FORMING APPARATUS

(75) Inventors: Yasushi Nakasone, Tokyo (JP); Takanori Mimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 123 days.

(21) Appl. No.: 11/374,203

(22) Filed: Mar. 14, 2006

(65) Prior Publication Data

US 2006/0210321 A1 Sep. 21, 2006

(30) Foreign Application Priority Data

Mar. 17, 2005 (JP) ..... 2005-076464
Feb. 9, 2006 (JP) ..... 2006-032331

(51) Int. Cl.
*G03G 15/08* (2006.01)

(52) U.S. Cl. ..... 399/284

(58) Field of Classification Search ..... 399/284, 399/274; 118/261
See application file for complete search history.

(56) References Cited

U.S. PATENT DOCUMENTS 5,649,197 A * 7/1997 Fujita ..... 399/284 X
5,805,966 A * 9/1998 Yamada ..... 399/284
6,137,980 A * 10/2000 Lee ..... 399/274
6,259,878 B1 * 7/2001 Sato et al. ..... 399/284
2001/0009618 A1 * 7/2001 Ohgoshi et al. ..... 399/284 X

FOREIGN PATENT DOCUMENTS

JP 62-017774 A * 1/1987
JP 07-084452 3/1995
JP 2006-003595 A * 1/2006

* cited by examiner

*Primary Examiner*—Sophia S. Chen
(74) *Attorney, Agent, or Firm*—Rabin & Berdo, PC

(57) ABSTRACT

A developing unit is provided, which includes a developer accommodating section to accommodate developer; a developing member to provide the developer accommodated in the developer accommodating section to an image carrying body by rotating; a developer layer forming member to forming a developer layer by shaving the developer on surface of the developing member; and a restricting member to restrict fluidity of the developer at a upstream side in a rotating direction of the developing member in front of a contact part of the developer layer forming member and the developing member.

16 Claims, 14 Drawing Sheets

DEVELOPING UNIT AND IMAGE FORMING APPARATUS

BACKGROUND OF THE INVENTION

1. Field of the Invention

The invention relates to a developing unit to develop an electrostatic latent image formed on an image carrying body by using developer, and relates to an image forming apparatus.

2. Related Background Art

Conventionally, a developing blade to restrict toner quantity on a developing roller is formed by bending the tip of elastic member of plate shape and has a tip portion with "L" character shape. It may refer to, for example, Patent Document 1: Japan patent publication H07-084452. Then, by pressing the outside plane of the bending tip to the developing roller and shaving a surplus toner on the developing roller, a toner layer is formed.

However, the developing blade disclosed in the above-stated Patent Document 1 makes the toner unevenly adhere along the axis direction of the developing roller, so on the developing blade to which the toner is adhering, there are place on which an adhering quantity of the toner is much and place on which an adhering quantity of the toner is less. Then, when the toner passes through between the developing roller and the developing blade, to correspond to the place to make the adhering quantity of the toner becomes much and to correspond to the place to make the adhering quantity of the toner becomes less, on the developing roller, there are place on which a toner quantity is little and place on which a toner quantity is many. Because of it, when a print is executed, a concentration unevenness in a vertical obi shape happened.

SUMMARY OF THE INVENTION

It is, therefore, an object of the invention to provide a developing unit and an image forming apparatus and an image forming system capable of solving the mentioned above problems, that is, capable of keeping the toner quantity adhering to the developing blade in a constant quantity, making the thickness of the toner layer on the developing roller become constant, and executing a print having no the concentration unevenness.

According to the present invention, there is provided a developing unit, comprising:

a developer accommodating section to accommodate developer;

a developing member to provide the developer accommodated in the developer accommodating section to an image carrying body by rotating;

a developer layer forming member to forming a developer layer by shaving the developer on surface of the developing member; and a restricting member to restrict fluidity of the developer at a upstream side in a rotating direction of the developing member in front of a contact part of the developer layer forming member and the developing member.

Moreover, in the developing unit, the developer layer forming member is made from an elastic member with plate shape, and has bending piece by bending the elastic member nearby the contact part toward outside of a radial direction of the developing member; and the restricting member adheres to the bending piece at a upstream side in a rotating direction of the developing member.

Moreover, in the developing unit, the developer layer forming member is made from an elastic member with plate shape, and has bending piece by bending the elastic member nearby the contact part toward outside of a radial direction of the developing member; and the restricting member is made from an elastic member with plate shape, contacts with the bending piece of the developer layer forming member, and upward extends to a blade holder at a upper side of the developer layer forming member.

Moreover, in the developing unit, the developer layer forming member is made from an elastic member with plate shape, and has bending piece by bending the elastic member nearby the contact part toward outside of a radial direction of the developing member; and the restricting member is formed by bending an elastic member with plate shape, the restricting member has a bending edge, the bending edge faces to the bending piece, and a space between the bending edge and the bending piece is set.

Moreover, in the developing unit, the developer layer forming member is made from an elastic member with plate shape, and has bending piece by bending the elastic member nearby the contact part toward outside of a radial direction of the developing member; and the restricting member is formed by bending an elastic member with plate shape, the restricting member has a bending edge to contact with the bending piece of the developer layer forming member.

Further, according to the present invention, there is also provided a developing unit, comprising:

a developer accommodating section to accommodate developer;

a developing member to provide the developer accommodated in the developer accommodating section to an image carrying body by rotating; and a developer layer forming member to restrict fluidity of said developer while forming a developer layer by shaving the developer on surface of the developing member.

Moreover, in the developing unit, the developer layer forming member has a contact part to contact with the developing member, and a restricting member to restrict fluidity of the developer.

Moreover, in the developing unit, the developer layer forming member is made from an elastic member with plate shape, and has by bending the elastic member nearby the contact part toward outside of a radial direction of the developing member; and the restricting member is formed by bending the bending piece toward inside of the radial direction of the developing member.

Furthermore, according to the present invention, there is provided an image forming apparatus, comprising:

an exposing section to expose an image carrying body and to form an electrostatic latent image; and a developing section to transfer a developer image formed by making developer adhere to the electrostatic latent image formed by the exposing section onto a record medium, wherein the developing section has a developer accommodating section to accommodate developer; a developing member to provide the developer accommodated in the developer accommodating section to the image carrying body by rotating; a developer layer forming member to forming a developer layer by shaving the developer on surface of the developing member; and a restricting member to restrict fluidity of the developer at a upstream side in a rotating direction of the developing member in front of a contact part of the developer layer forming member and the developing member.

Moreover, in the image forming apparatus, the developer layer forming member is made from an elastic member with plate shape, and has bending piece by bending the elastic member nearby the contact part toward outside of a radial direction of the developing member; the restricting member adheres to the bending piece at a upstream side in a rotating direction of the developing member.

Moreover, in the image forming apparatus, the developer layer forming member is made from an elastic member with plate shape, and has bending piece by bending the elastic member nearby the contact part toward outside of a radial direction of the developing member; and the restricting member is made from an elastic member with plate shape, contacts with the bending piece of the developer layer forming member, and upward extends to a blade holder at a upper side of the developer layer forming member.

Moreover, in the image forming apparatus, the developer layer forming member is made from an elastic member with plate shape, and has bending piece by bending the elastic member nearby the contact part toward outside of a radial direction of the developing member; and the restricting member is formed by bending an elastic member with plate shape, the restricting member has a bending edge, the bending edge faces to the bending piece, and a space between the bending edge and the bending piece is set.

Moreover, in the image forming apparatus, the developer layer forming member is made from an elastic member with plate shape, and has bending piece by bending the elastic member nearby the contact part toward outside of a radial direction of the developing member; and the restricting member is formed by bending an elastic member with plate shape, the restricting member has a bending edge to contact with the bending piece of the developer layer forming member.

Further, according to the present invention, there is provided an image forming apparatus, comprising:

an exposing section to expose an image carrying body and to form an electrostatic latent image; and a developing section to transfer a developer image formed by making developer adhere to the electrostatic latent image formed by the exposing section onto a record medium, wherein the developing section has a developer accommodating section to accommodate developer; a developing member to provide the developer accommodated in the developer accommodating section to the image carrying body by rotating; and a developer layer forming member to restrict fluidity of said developer while forming a developer layer by shaving the developer on surface of the developing member.

Moreover, in the image forming apparatus, the developer layer forming member has a contact part to contact with the developing member, and a restricting member to restrict fluidity of the developer.

Moreover, in the image forming apparatus, the developer layer forming member is made from an elastic member with plate shape, and has by bending the elastic member nearby the contact part toward outside of a radial direction of the developing member; and the restricting member is formed by bending the bending piece toward inside of the radial direction of the developing member.

The above and other objects and features of the present invention will become apparent from the following detailed description and the appended claims with reference to the accompanying drawings.

EFFECTS OF THE PRESENT INVENTION

The developing unit of the present invention enables the fluidity of the developer to drop and enables a pressure on the developer layer forming member to become uniform in a length direction. Therefore, it is possible to obtain a toner layer having a stable thickness. As a result, it is possible to obtain an image print which is high quantity and is uniform in concentration.

Further, the image forming apparatus of the present invention enables the fluidity of the developer to drop and enables a pressure on the developer layer forming member to become uniform in a length direction. Therefore, it is possible to obtain a toner layer having a stable thickness on developing roller and to obtain a toner layer which does not make a print occur concentration unevenness in a vertical direction. As a result, it is possible to obtain an print image which has high quantity.

BRIEF DESCRIPTION OF THE DRAWINGS

FIG. 5 is a magnified cross section showing C-C' cross section of a developing roller and a developing blade in FIG. 4 from an arrow direction a;

FIG. 7 is a magnified cross section showing A-A' cross section of a developing roller and a developing blade in FIG. 6 from an arrow direction a;

FIG. 8 is a magnified cross section showing B-B' cross section of a developing roller and a developing blade in FIG. 6 from an arrow direction a;

FIG. 19 is a magnified cross section showing D-D' cross section of a developing roller and a developing blade in FIG. 18 from an arrow direction a.

DETAILED DESCRIPTION OF THE PREFERRED EMBODIMENTS

Embodiments of the invention will be described in detail hereinbelow with reference to the drawings.

Embodiment 1

Figure 1:
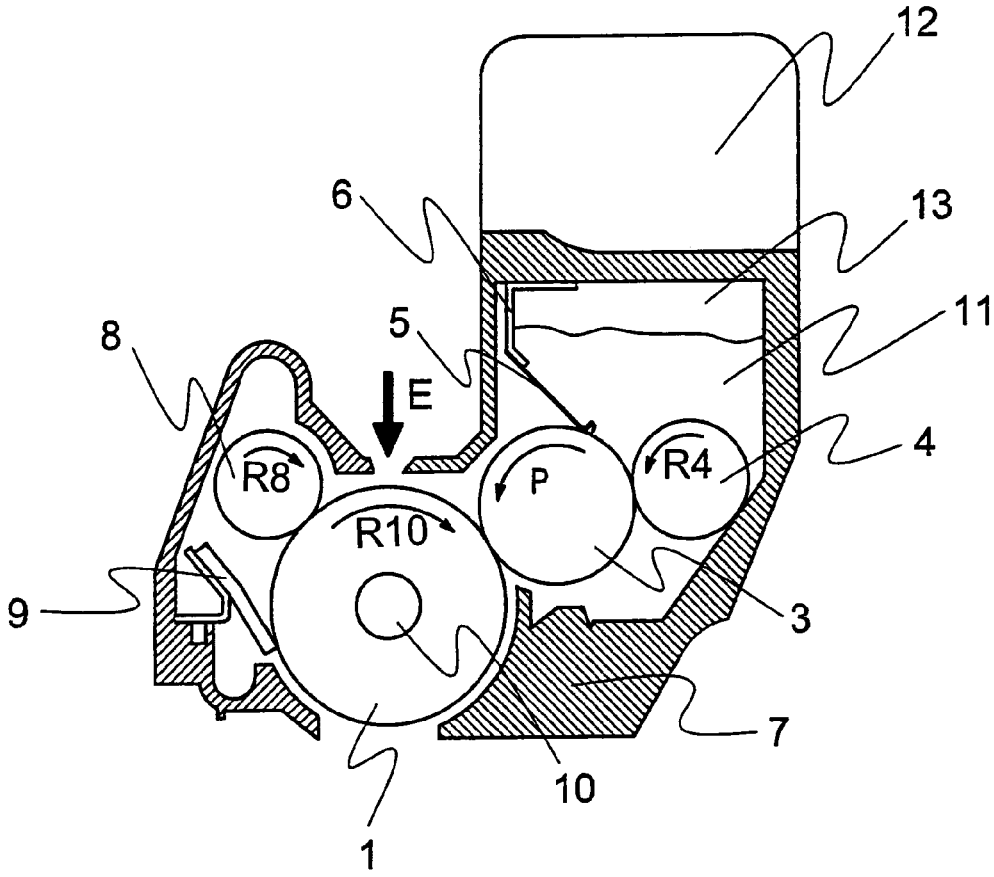
FIG. 1 is a cross section showing a structure of a developing unit of the present invention.

FIG. 1 is a cross section showing a structure of a developing unit of the present invention.

In the embodiment 1, a developing unit of the present invention includes a photosensitive drum 1 as an image carrying body, a developing roller 3 as developing member, a providing roller 4, a developing blade 5 as developer layer forming member, a blade holder 6, a frame 7, a charging roller 8, a cleaning blade 9, a fixed shaft 10, toner 11 as developer, a toner cartridge 12 as a developer accommodating section, and a toner tank 13.

The photosensitive drum 1 is constructed by a basic layer with electroconductivity made from Aluminum and the like and by a surface layer made from organic photosensitive member. The photosensitive drum us fixed onto both sides of the frame 7 as being rotatable around the fixed shaft 10 as a center axis along an arrow direction R10. The photosensitive drum 1 serves as an image carrying body to carry an electrostatic latent image, its surface can save electric charge. The electric charge saved on the surface can be removed by an exposure of an exposing section (not shown in drawing). By making the toner 11 as developer adhere to the surface of the photosensitive drum 1 whose surface is formed an electrostatic latent image, the electrostatic latent image becomes visible.

The developing roller 3 is made by forming semiconductivity rubber such as silicon rubber and the like onto a metal shaft with electroconductivity. The developing roller 3 is fixed onto the frame 7 rotating-freely along an arrow direction, as contacting with the surface of the photosensitive drum 1 under a fixed pressure. Through the developing roller 3 is added a predetermined positive voltage or a predetermined negative voltage, the developing roller 3 develops the electrostatic latent image formed on the surface of the photosensitive drum 1 by toner. At that time, the developing roller 3 provides the toner 11 to the photosensitive drum 1 by rotating.

The providing roller 4 is formed by adding a foaming agent while mixing rubber onto a metal shaft with electroconductivity in order to improve a conveyance ability for toner. The providing roller 4 is fixed onto the frame 7 rotating-freely along the same arrow direction i.e. R4 direction as the developing roller 3, as contacting with the surface of the developing roller 3 under a fixed pressure at a rotation upstream side in front of the contacting position of the photosensitive drum 1 and the developing roller 3. The providing roller provides the toner 11 that is supplied to the toner tank 13 from the toner cartridge 12 to the developing roller 3. On the providing roller 4, a predetermined positive voltage or a predetermined negative voltage is added.

The charging roller 8 is made by forming semiconductivity rubber such as Epichlorohydrin rubber and the like onto a metal shaft with electroconductivity in a roll shape. The charging roller 8 is fixed onto the frame 7 rotating-freely along the same arrow direction i.e. C direction as the photosensitive drum 1, as contacting with the surface of the photosensitive drum 1 under a fixed pressure at a rotation upstream side in front of the contacting position of the photosensitive drum 1 and the developing roller 3. Through the charging roller 8 adds a predetermined positive voltage or a predetermined negative voltage with respect to the photosensitive drum 1, the charging roller 8 charges the photosensitive drum. Moreover, when print is operated, on the charging roller 8, the developing roller 3 and the providing roller 4, a negative voltage is added.

The charging roller 8 is made by forming semiconductivity rubber such as Epichiorohydrin rubber and the like onto a metal shaft with electroconductivity in a roll shape. The charging roller 8 is fixed onto the frame 7 rotating-freely along the same arrow direction i.e. R8 direction as the photosensitive drum 1, as contacting with the surface of the photosensitive drum 1 under a fixed pressure at a rotation upstream side in front of the contacting position of the photosensitive drum 1 and the developing roller 3. Through the charging roller 8 adds a predetermined positive voltage or a predetermined negative voltage with respect to the photosensitive drum 1, the charging roller 8 charges the photosensitive drum. Moreover, when print is operated, on the charging roller 8, the developing roller 3 and the providing roller 4, a negative voltage is added.

The toner cartridge 12 is located the upwardness of the providing roller 4, and is placed the upper of the frame 7 as attached and removed freely. The toner cartridge 12 accommodates the toner 11 as developer, and provides the accommodated toner 11 to the toner tank 13 in the under frame 7. Then, the toner 11 of the toner tank 13 is provided to the developing roller 3 by the providing roller 4.

Over the photosensitive drum 1, an exposing section (not shown in drawing) is placed to form an electrostatic latent image on the surface of the photosensitive drum 1. The exposing section irradiates the surface of the photosensitive drum 1 in an arrow direction E with light corresponding to image signal, and forms an electrostatic latent image on the photosensitive drum 1. As such exposing section, for example, it may be a combination of a LED (Light Emitting Diode) array and an array such as Selfoc Lens Array (SLA, commodity name), also may be a combination of a laser and an imaging optical system, and also may be any component.

The developing blade 5 is made from plate shape elastic member having a uniform thickness such as a stainless plate and the like. The developing blade 5 is fixed onto the frame 7 via a blade holder 6, its one end is pressed to the surface of the developing roller 3 at a rotation upstream side of the developing roller 3, in front of the contacting position of the photosensitive drum 1 and the developing roller 3, and a contact angle Q is an acute angle with respect to a rotation downstream side of the developing roller 3. The developing blade 5 shaves the toner 11 provided on the surface of the developing roller 3 by the providing roller 4, and controls the thickness of the layer of the toner 11 formed on the surface of the developing roller 3.

Figure 2:
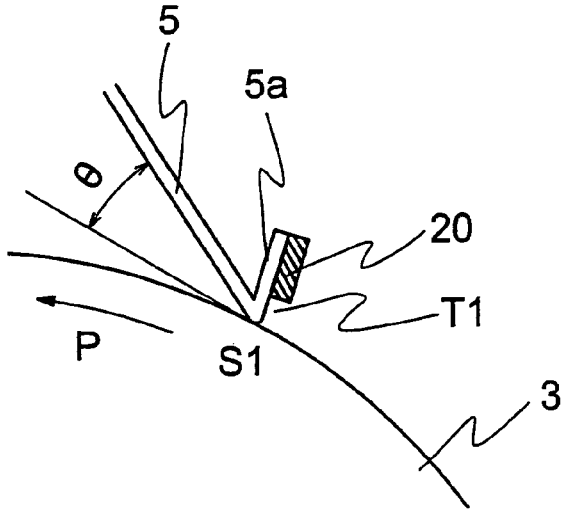
FIG. 2 is a cross section showing shapes of a developing roller and a developing blade of a developing unit in embodiment 1 of the present invention.

FIG. 2 is a cross section showing shapes of a developing roller and a developing blade of a developing unit in embodiment 1 of the present invention.

In the developing blade 5 pressed to the developing roller 3, as shown by FIG. 2, the one end contacting with the developing roller 3 is bending toward outside of the radial direction of the developing roller as having a "L" character shape, and a bending piece 5*a* is formed on the developing blade 5. Because the developing blade 5 having the "L" character shape does not hit in waves at the contacting position contacting with the developing roller 3, it is possible to secure a constant pressure. Then, in the developing blade 5, the bending outside surface contacting directly with the developing roller 3 is smoothly processed by polish. On the tip of the bending piece 5*a*, a restricting member 20 with a rectangular shape is mounted over the surface of the developing roller 3. Through the developing roller 3, the bending piece 5*a* and the restricting member 20, a toner fluidity dropping area T1 is formed to drop the fluidity of the toner 11.

Next is to explain the developing unit in the embodiment 1 of the present invention by using FIGS. 1, 3, 4 and 5.

Figure 3:
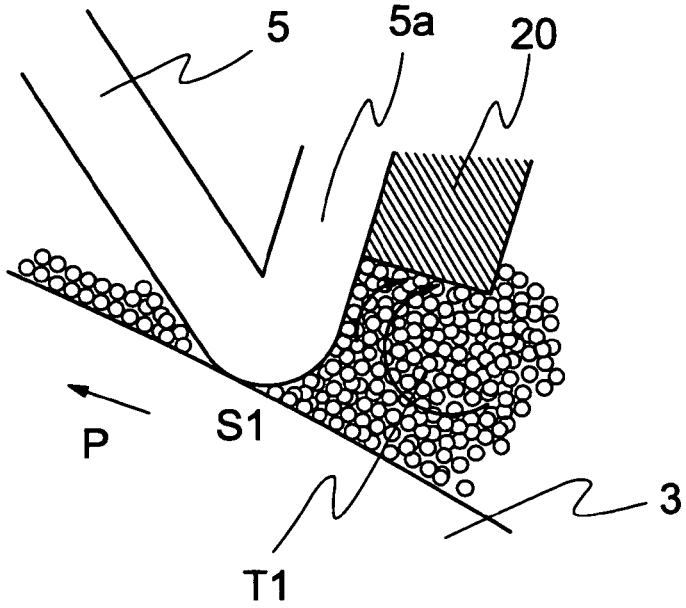
FIG. 3 is a magnified cross section showing a contact part of a developing roller and a developing blade of a developing unit in embodiment 1 of the present invention.
Figure 4:
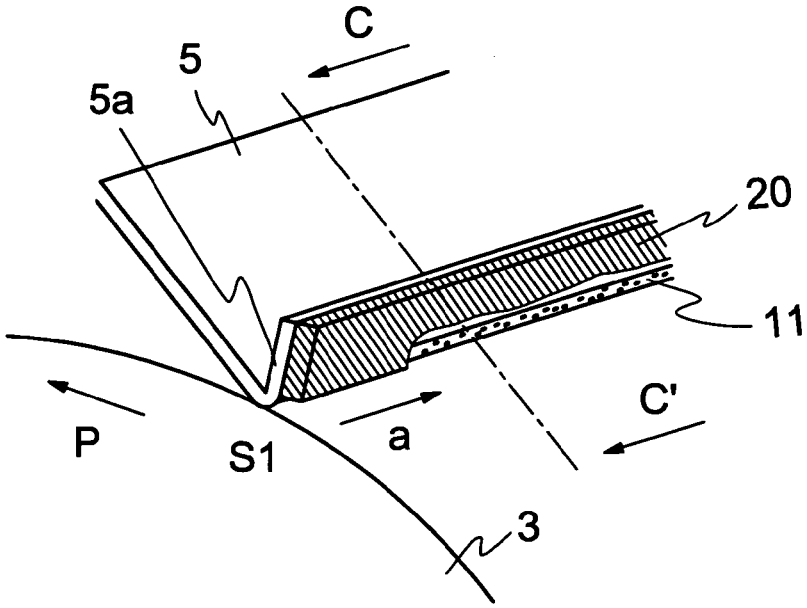
FIG. 4 is a drawing showing a developing roller and a developing blade of a developing unit in embodiment 1 of the present invention.
Figure 5:
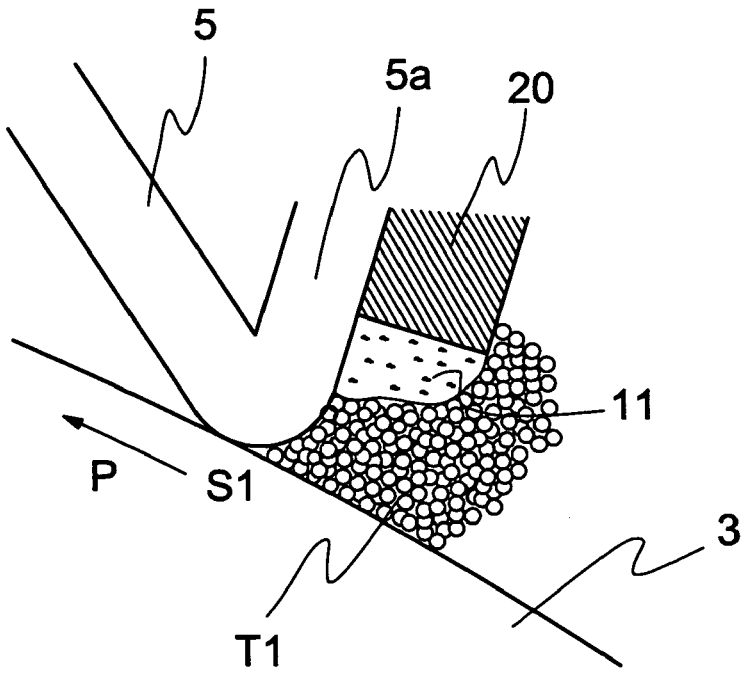

FIG. 3 is a magnified cross section showing a contact part of a developing roller and a developing blade of a developing unit in embodiment 1 of the present invention; FIG. 4 is a drawing showing a developing roller and a developing blade of a developing unit in embodiment 1 of the present invention; and FIG. 5 is a magnified cross section showing C-C' cross section of a developing roller and a developing blade in FIG. 4 from an arrow direction a.

When a driving motor (not shown in drawing) and a power source circuit (not shown in drawing) operates, the developing roller 3 and the providing roller 4 rotate respectively along the arrow directions P and B, then the toner 11 in the toner tank 13 is provided to the developing roller 3 by the providing roller 4. Through the rotation of the developing roller 3, the toner 11 provided to the developing roller 3 reaches a toner layer forming section Si which is a contact part of the developing roller 3 and the developing blade 5.

On the developing blade 5 provided in the developing unit, the restricting member 20 is adhering for restricting the fluidity of the toner 11, then through the restricting member 20 adhering to the developing blade 5, the fluidity of the toner 11 drops, and the toner 11 becomes easy to remain in the toner fluidity dropping area T1.

In the toner fluidity dropping area T1, as shown by FIG. 3, a state that it is overflowingly filled with the toner 11 is produced. Therefore, the pressure on the toner layer forming section S1 is almost uniform along the length direction of the developing blade 5, a stable layer of the toner 11 can be formed on the developing roller 3.

Then, a surplus toner 11 shaved by the developing blade 5, as shown by FIG. 4, adheres to the circumference of the toner layer forming section S1 as a contact part of the bending piece 5*a* and the developing roller 3. In the case, as shown by FIG. 5, through the toner 11 un-adhering to the developing blade 5, the toner fluidity dropping area T1 is overflowingly filled with the toner 11 immediately. In this state, because the toner 11 adhering to the developing blade 5 has no place to escape, even if the toner 11 adhering to the developing blade 5 received a force produced by the arriving toner 11, it does not fall off. That is, the pressure on the toner layer forming section S1 is almost uniform along the length direction of the developing blade 5, a stable layer of the toner 11 can be formed on the developing roller 3.

Further, in a state that the toner fluidity dropping area T1 is not full of the toner 11, through a force produced by the toner 11 which has arrived but does not adhere to the developing blade 5, in general, there is a possibility that the toner 11 adhering to the developing blade 5 falls off. In the case, the toner 11 having fallen off the developing blade 5 is left in the toner fluidity dropping area T1 by the restricting member 20 and is used to fill the toner fluidity dropping area T1 together with the toner 11 un-adhering to the developing blade 5. Therefore, in the case, the pressure on the toner layer forming section S1 is also almost uniform along the length direction of the developing blade 5, a stable layer of the toner 11 can also be formed on the developing roller 3.

Moreover, even if the toner 11 adhering to the developing blade 5 is uneven in the length direction of the developing blade 5, as mentioned above, because the restricting member 20 is provided, on any place of the developing blade 5 in the length direction of the developing blade 5, the toner 11 has a identical state in the toner fluidity dropping area T1, so a stable layer of the toner 11 can also be formed on the developing roller 3.

Thus, in the toner layer forming section S1, the surplus toner of the toner 11 provided to the developing roller 3 is shaved by the developing blade 5 having the restricting member 20, as shown by FIG. 3, the thickness of the layer of the toner 11 formed on the developing roller 3 is limited to a constant. The toner 11 whose layer thickness is limited to a constant is conveyed to the photosensitive drum 1 with the rotation of the developing roller 3. On the other hand, the surface of the photosensitive drum 1 is kept in an uniform electric potential by the charging roller 8, and an electrostatic latent image is formed by the exposure of the exposing section (not shown in drawing). Then, the photosensitive drum 1 on which the electrostatic latent image is formed is developed by the toner 11 adhering to the developing roller 3.

Figure 6:
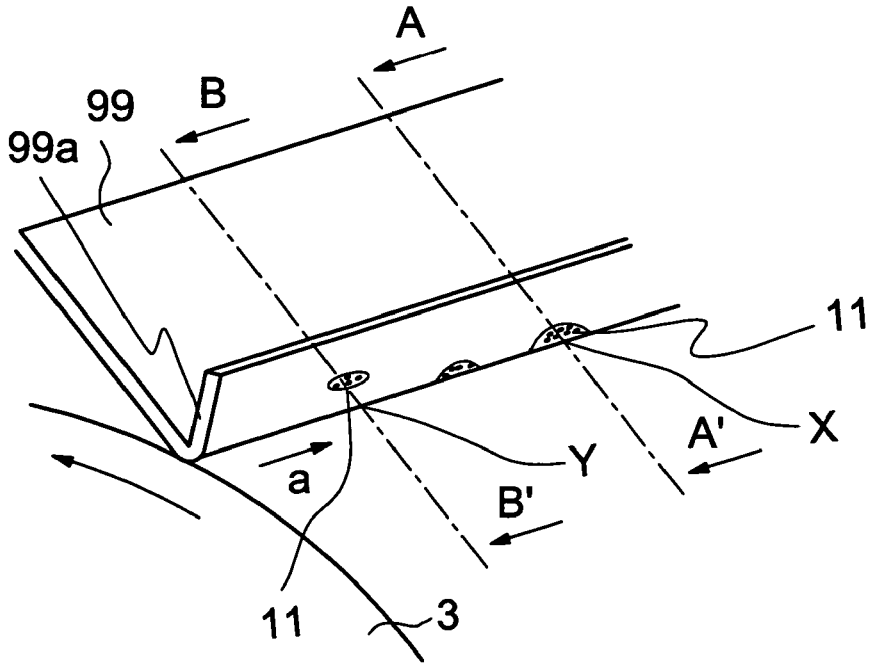
FIG. 6 is a drawing showing a developing roller and a developing blade having no restricting member.
Figure 7:
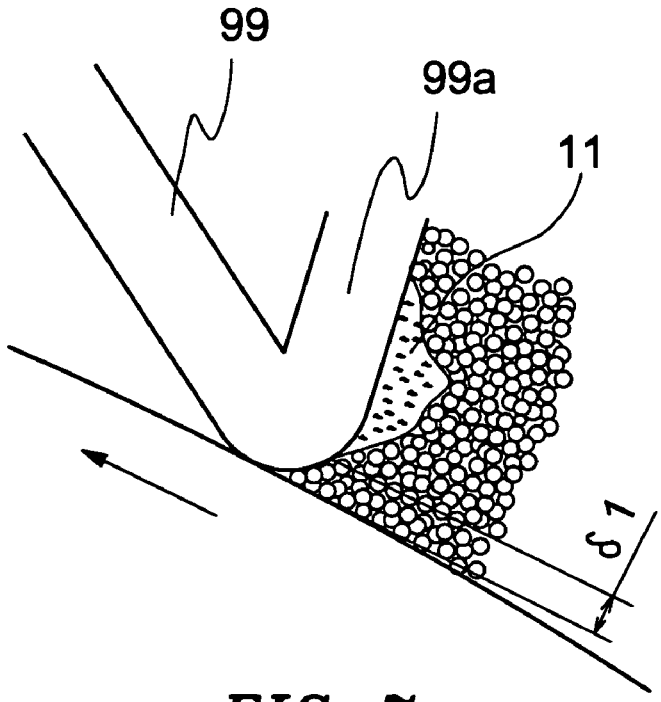
Figure 8:
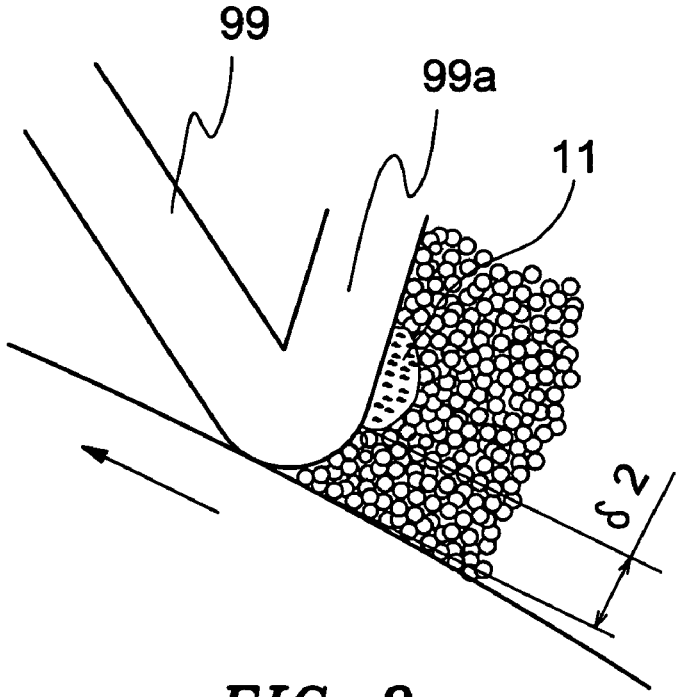

Here, as a comparison example, in the case that to use a developing blade 99 having no the restricting member 20, regarding the formation of the layer of the toner 11 to adhere to the developing roller 3, it is explained by using FIGS. 6, 7 and 8.

FIG. 6 is a drawing showing a developing roller and a developing blade having no restricting member; FIG. 7 is a magnified cross section showing A-A' cross section of a developing roller and a developing blade in FIG. 6 from an arrow direction a; and FIG. 8 is a magnified cross section showing B-B' cross section of a developing roller and a developing blade in FIG. 6 from an arrow direction a.

When using the developing blade 99, as shown by FIG. 6, the shaved surplus toner 11 also adheres to the circumference of a toner layer forming section as a contact part of a bending piece 99*a* and the developing roller 3.

The FIG. 7 shows a X area in which an adhering quantity of the toner 11 is many. In the X area, the toner 11 adhering to the developing blade 99 is many, an area δ 1 enabling the arrived toner 11 to pass through the developing blade 99 is narrow. Thereby, the quantity of the toner 11 entering the area δ 1 becomes little. Then, because there is no a restricting member 20 on the developing blade 99, the toner 11 becomes difficult to remain, and the most of the toner 11 moves along the bending piece 99*a* of the developing blade 99 toward the outside of a radial direction of the developing roller 3. Therefore, a pressure on the toner layer forming section becomes low, the quantity of the toner 11 passing through the developing blade 99 becomes little.

The FIG. 8 shows a Y area in which an adhering quantity of the toner 11 is little. In the Y area, the toner 11 adhering to the developing blade 99 is little, an area δ 2 enabling the arrived toner 11 to pass through the developing blade 99 is wide. Thereby, the quantity of the toner 11 entering the area δ 2 becomes many. Therefore, a pressure on the toner layer forming section becomes high, the quantity of the toner 11 passing through the developing blade 99 becomes many.

Further, the toner 11 adhering to the developing blade 99 receives a force from the toner layer forming section toward the bending piece 99*a* by the arrived toner 11 conveyed by the developing roller 3. Through the force, there is a possibility that the toner 11 adhering to the developing blade 99 falls off, and also there is a possibility that the arrived toner 11 adheres to the developing blade 99. Therefore, the toner 11 adhering to the developing blade 99 is in a change state according to different time.

That is, as shown by FIGS. 7 and 8, because the adhering quantity of the toner 11 adhering to the developing blade 99 is different along the length direction of the developing blade 99, the area enabling the arrived toner 11 to pass through the developing blade 99 changes such as the different areas δ 1 and δ 2. Therefore, a pressure of the toner 11 conveyed to the toner layer forming section is uneven in the length direction of the developing blade 99. Then, place having thicker layer of the toner 11 and place having thinner layer of the toner 11 are formed, and a concentration unevenness in a vertical obi shape happens. Further, the toner 11 adhering to the developing blade 99 is in a change state according to different time, so the concentration unevenness changes timely.

Therefore, in the developing unit of the present invention, because the developing blade 5 is provided with the restricting member 20, the fluidity of the toner 11 is dropped, the pressure on the toner layer forming section S1 becomes almost constant in the length direction of the developing blade 5, and the thickness of the layer of the formed toner 11 is stable. As a result, it is possible to obtain a print having high image quality and having no concentration unevenness.

Embodiment 2

A restricting member provided to the developing blade in the developing unit of the present invention is not limited by the restricting member 20 in the embodiment. In embodiment 2, regarding a developing unit having a developing blade 5 provided with a restricting member 40 whose shape is different from the restricting member 20 provided to the developing blade 5 in the embodiment 1, it is explained by referring to drawings. Moreover, regarding the repeated members, the identical symbol is set, and the corresponding explanation is omitted.

Figure 9:
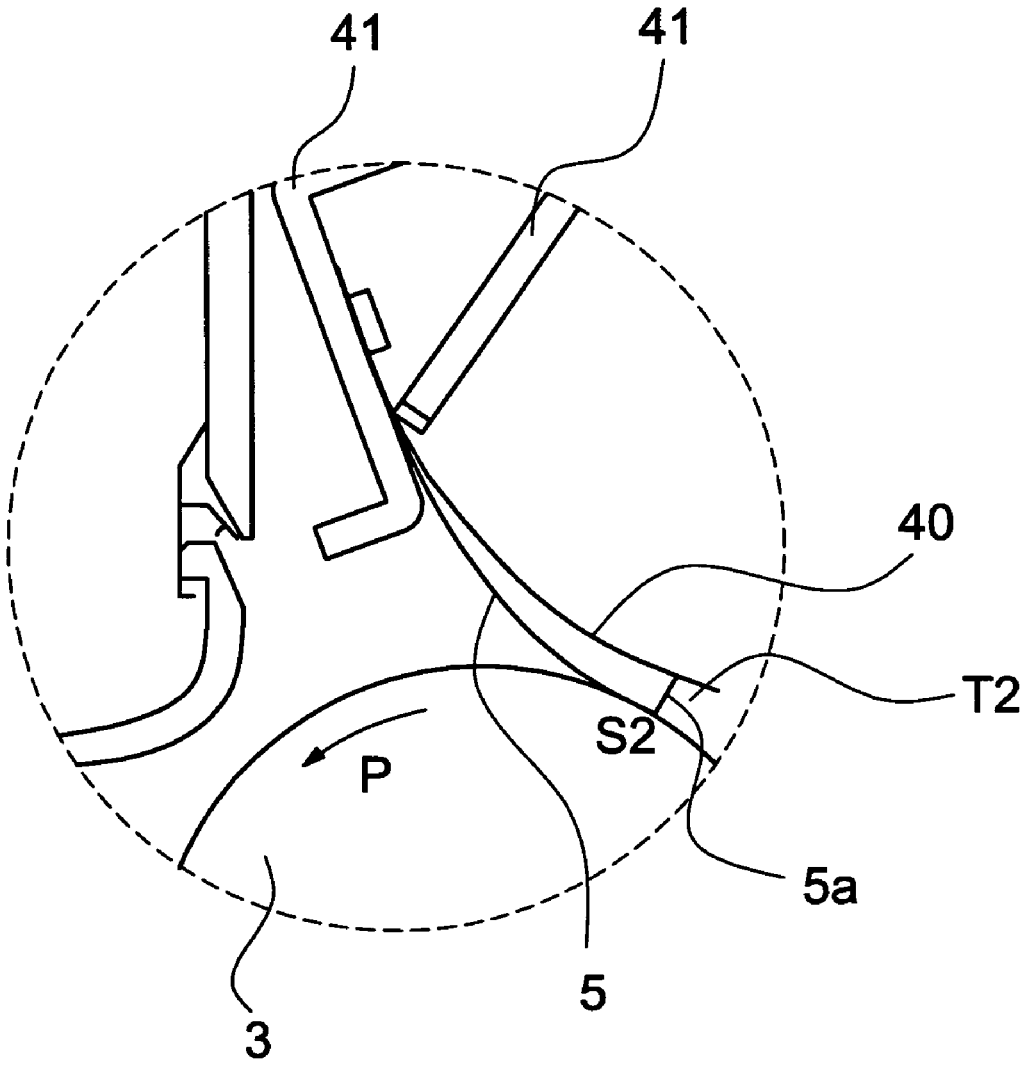
FIG. 9 is a cross section showing shapes of a developing roller and a developing blade of a developing unit in embodiment 2 of the present invention.
Figure 10:
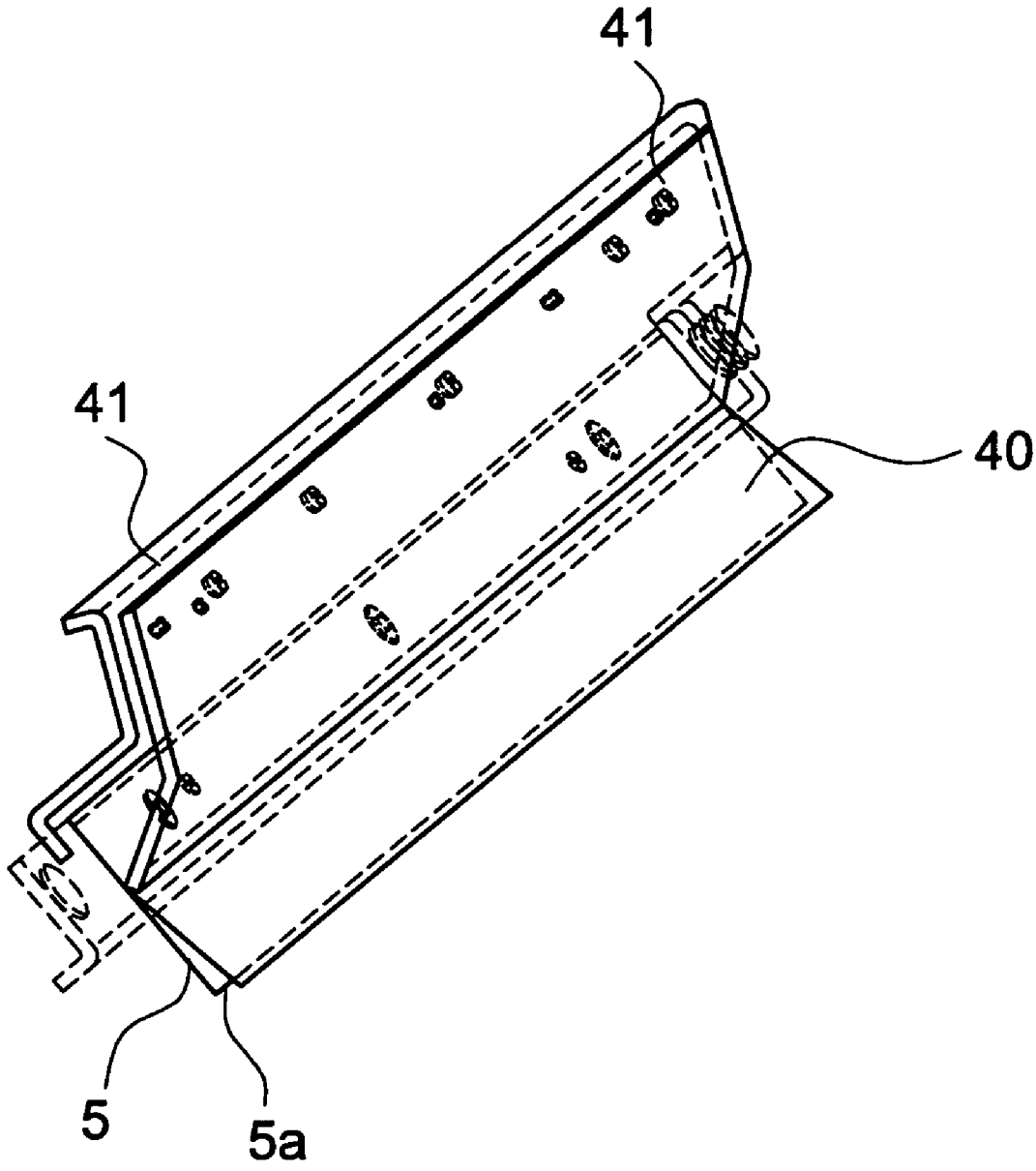
FIG. 10 is a drawing showing a shape of a developing blade of a developing unit in embodiment 2 of the present invention.

FIG. 9 is a cross section showing shapes of a developing roller and a developing blade of a developing unit in embodiment 2 of the present invention; and FIG. 10 is a drawing showing a shape of a developing blade of a developing unit in embodiment 2 of the present invention.

In the embodiment 2, as shown by FIG. 9, a developing unit of the present invention includes a developing blade 5, a restricting member 40 and a blade holder 41 to replace the developing blade 5, the restricting member 20 and the blade holder 6 in the embodiment 1.

The developing blade 5 is almost same as that in embodiment 1. On the developing blade 5, a restricting member 40 is provided. The restricting member 40 is made from a elastic member with plate shape, its one edge contacts with one end of the bending piece 5*a* of the developing blade 5 on the side the developing blade 5 does not contact with the developing roller 3, then the restricting member 40 is installed as upward extending from the one end of the bending piece 5*a* to a rotation upstream side of the developing roller 3 (an arrow direction P. That is, the restricting member 40 is installed as covering the tip of the bending piece 5*a* of the developing blade 5. Thus, it is possible to sufficiently secure a pressure between the developing roller 3 and the developing blade 5.

As shown by FIG. 10, the developing blade 5 and the restricting member 40 are fixed on the frame 7 by the blade holder 41. The blade holder 41 is formed from two members as sandwiching the developing blade 5 and the restricting member 40, and can use screws on predetermined places. The blade holder 41, as shown by FIGS. 9 and 10, sandwiches the developing blade 5 and the restricting member 40 through fixing the other edge of the restricting member 40 and the other end having no the bending piece 5*a* of the developing blade 5 by the screws. Then, a blade having the sandwiched developing blade 5 and the sandwiched restricting member 40 is fixed on the frame 7 as contacting with the developing roller 3 at the bending part of the developing blade 5 in a fixed pressure. Thereby, through the developing roller 3, the bending piece 5*a* and the restricting member 40, a toner fluidity dropping area T2 to drop the fluidity of the toner 11 is formed.

Figure 11:
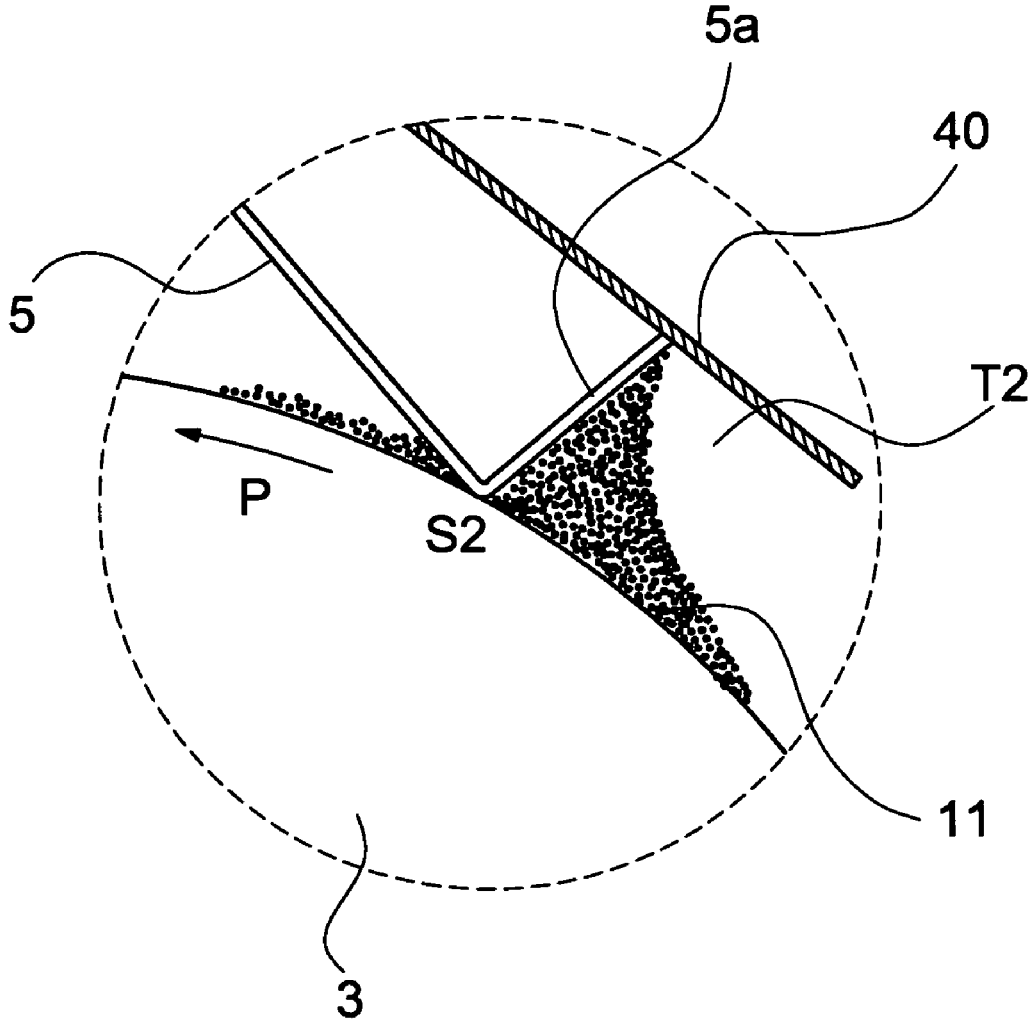
FIG. 11 is a magnified cross section showing a contact part of a developing roller and a developing blade of a developing unit in embodiment 2 of the present invention.

Next is to explain the developing unit in the embodiment 2 of the present invention by using FIGS. 9 and 11.

FIG. 11 is a magnified cross section showing a contact part of a developing roller and a developing blade of a developing unit in embodiment 2 of the present invention.

As stated in embodiment 1, when a driving motor (not shown in drawing) and a power source circuit (not shown in drawing) operates, the developing roller 3 and the providing roller 4 rotate respectively along the arrow directions P and B, then the toner 11 in the toner tank 13 is provided to the developing roller 3 by the providing roller 4. Through the rotation of the developing roller 3, the toner 11 provided to the developing roller 3 reaches a toner layer forming section S2 which is a contact part of the developing roller 3 and the developing blade 5.

On the developing blade 5 provided in the developing unit, the restricting member 40 is provided for restricting the fluidity of the toner 11. Because the restricting member 40 contacts with the tip of the bending piece 5*a* of the developing blade 5, and is installed as upward extending from the bending piece 5*a* at the upstream side of the rotation direction (the arrow direction P of the developing roller 3, the fluidity of the toner 11 drops, and the toner 11 becomes easy to remain in a toner fluidity dropping area T2.

Then, through the developing roller 3 rotates along the arrow direction P, the conveyed toner 11 is saved and the toner fluidity dropping area T2 is full of the toner 11. Because of it, the toner 11 is not be pressed by arrived surplus toner 11 and does not fall off the bending piece 5*a*. The restricting member 40 crosses in the length direction of the developing blade 5, the toner 11 always is in an adhering state along the length. In the case, regardless of the quantity of the toner 11 in the toner tank 13, because the toner 11 always is in an adhering state, it is possible to form a uniform toner layer on the surface of the developing roller 3.

Therefore, in the developing unit of the present invention, through the restricting member 40 is provided as covering the tip of the bending piece 5*a* of the developing blade 5, it is possible to sufficiently secure a pressure between the developing roller 3 and the developing blade 5. Then, in the developing unit of the present invention, the fluidity of the toner 11 is dropped, the pressure on the toner layer forming section S2 becomes almost constant in the length direction of the developing blade 5, and the thickness of the layer of the formed toner 11 is stable. As a result, it is possible to obtain a print having high image quality and having no concentration unevenness.

Embodiment 3

In embodiment 3, regarding a developing unit having a developing blade 5 provided with a restricting member 50 whose shape is different from the restricting member 40 provided to the developing blade 5 in the embodiment 2, it is explained by referring to drawings. Moreover, regarding the same members as that in the embodiment 2, the identical symbol is set, and the corresponding explanation is omitted.

Figure 12:
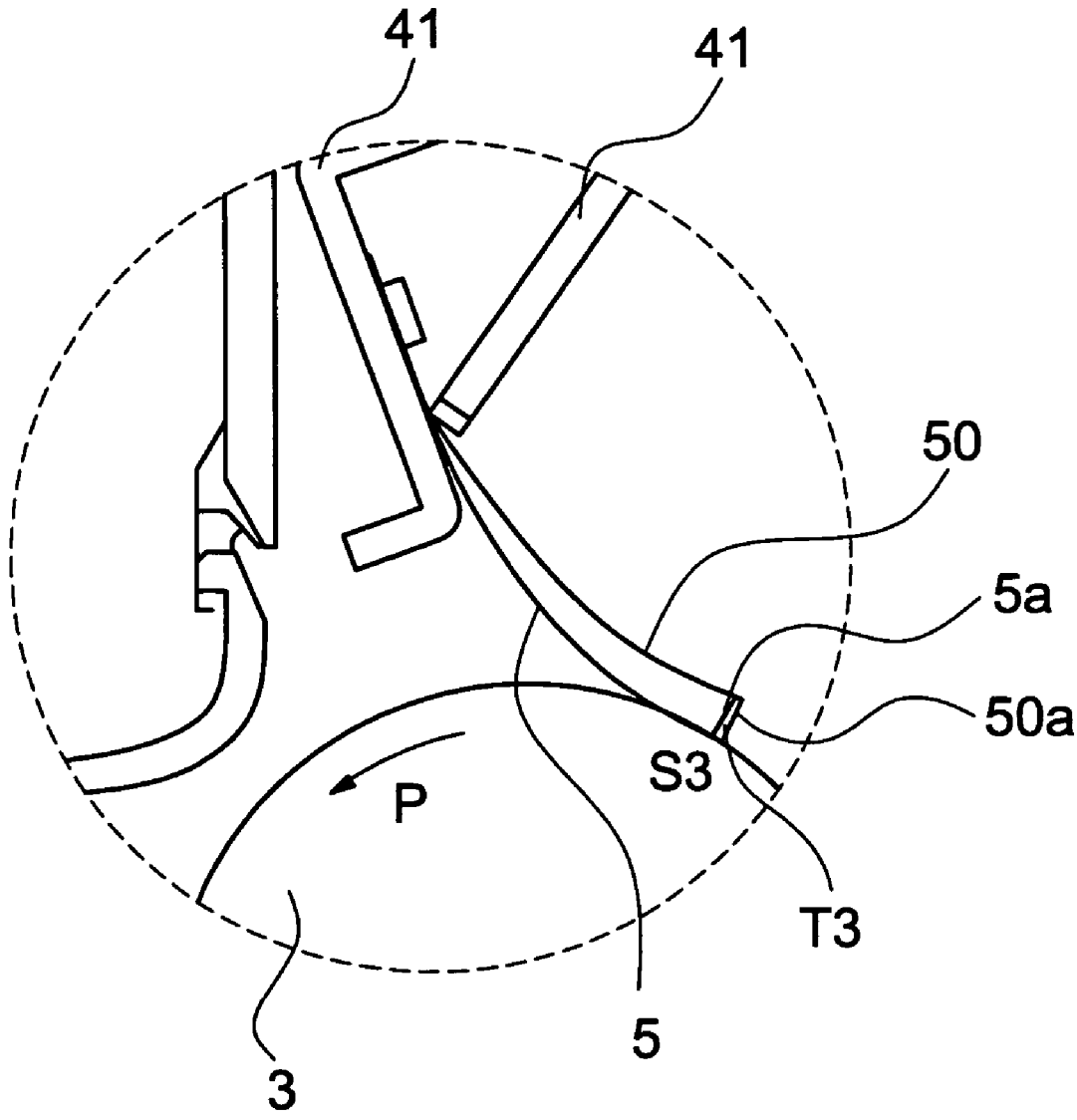
FIG. 12 is a cross section showing shapes of a developing roller and a developing blade of a developing unit in embodiment 3 of the present invention.
Figure 13:
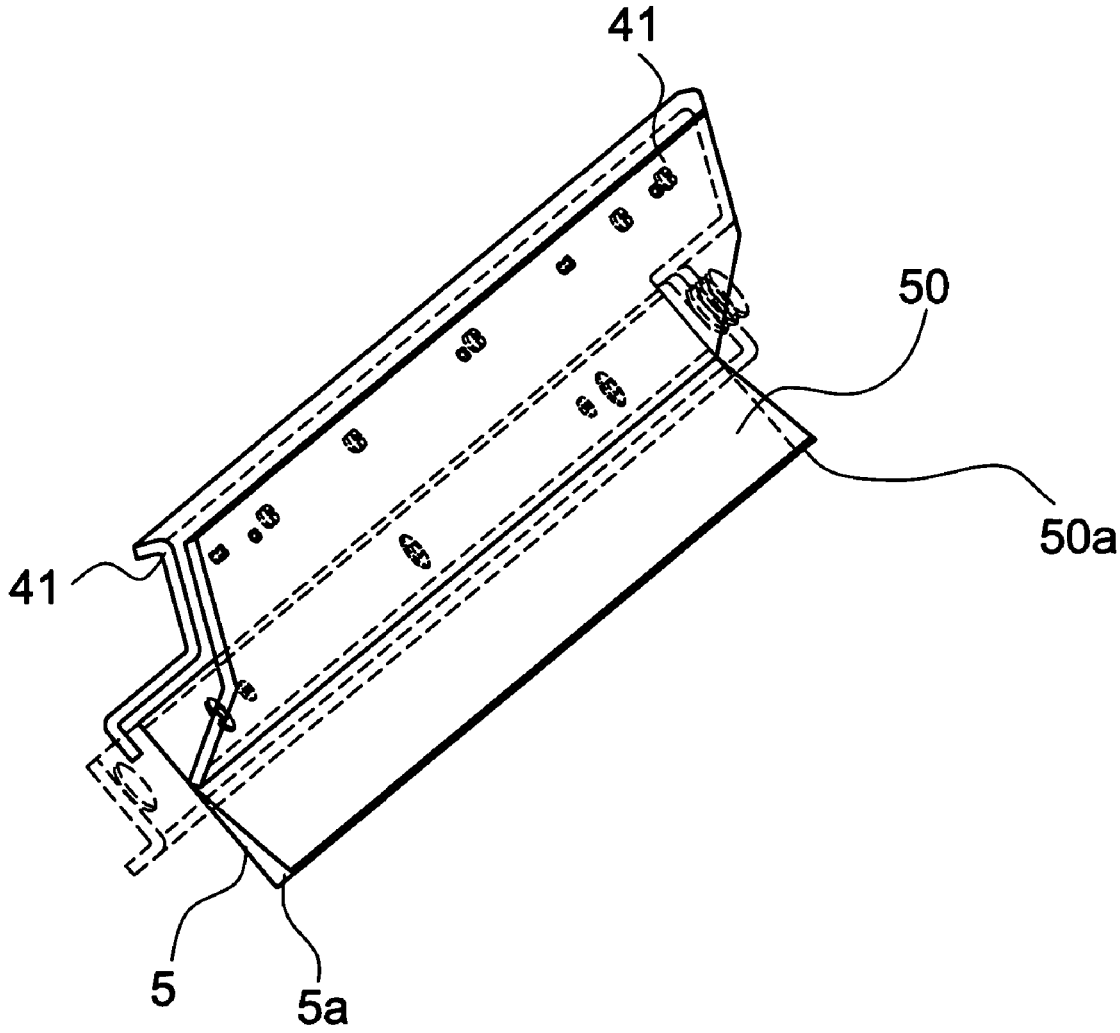
FIG. 13 is a drawing showing a shape of a developing blade of a developing unit in embodiment 3 of the present invention.

FIG. 12 is a cross section showing shapes of a developing roller and a developing blade of a developing unit in embodiment 3 of the present invention; and FIG. 13 is a drawing showing a shape of a developing blade of a developing unit in embodiment 3 of the present invention.

In the embodiment 3, as shown by FIG. 12 a developing unit of the present invention includes a restricting member 50 to replace the restricting member 40 in the embodiment 2.

The developing blade 5 is almost same as that in embodiment 2. On the developing blade 5, a restricting member 50 is provided. The restricting member 50 is made from a elastic member with plate shape, its one edge is fixed by the blade holder 41, an its other edge is bent as a bending edge 50*a*. Then, in the restricting member 50, the bending edge 50*a* is located as facing to the bending piece 5*a* of the developing blade 5, and does not contact with the bending piece 5*a* of the developing blade 5. In between the bending piece 5*a* and the bending edge 50*a*, a predetermined space is formed. That is, the developing blade 5 and the restricting member 50 are set to contact, as that the side plane of the tip of the bending piece 5*a* does not contact with the side plane of the tip of the bending edge 50*a*, in a state that the tip of the bending piece 5*a* faces to the tip of the bending edge 50*a*. Further, in the restricting member 50, through adjusting the length of the bending edge 50*a*, the tip of the bending edge 50*a* is set to un-contact with the developing roller 3. That is, the restricting member 50 is provided as covering the bending piece 5*a* of the developing blade 5. Therefore, it is possible to sufficiently secure a pressure between the developing roller 3 and the developing blade 5.

As shown by FIG. 13, the developing blade 5 and the restricting member 50 are fixed on the frame 7. The blade holder 41 is formed from two members as sandwiching the developing blade 5 and the restricting member 50, and can use screws on predetermined places. The blade holder 41, as shown by FIGS. 12 and 13, sandwiches the developing blade 5 and the restricting member 50 through fixing the other edge of the restricting member 50 and the other end having no the bending piece 5*a* of the developing blade 5 by the screws. Then, a blade having the sandwiched developing blade 5 and the sandwiched restricting member 50 is fixed on the frame 7 as contacting with the developing roller 3 at the bending part of the developing blade 5 in a fixed pressure. Thereby, through the space among the developing roller 3, the bending piece 5*a* and the bending edge 50*a*, a toner fluidity dropping area T3 to drop the fluidity of the toner 11 is formed.

Figure 14:
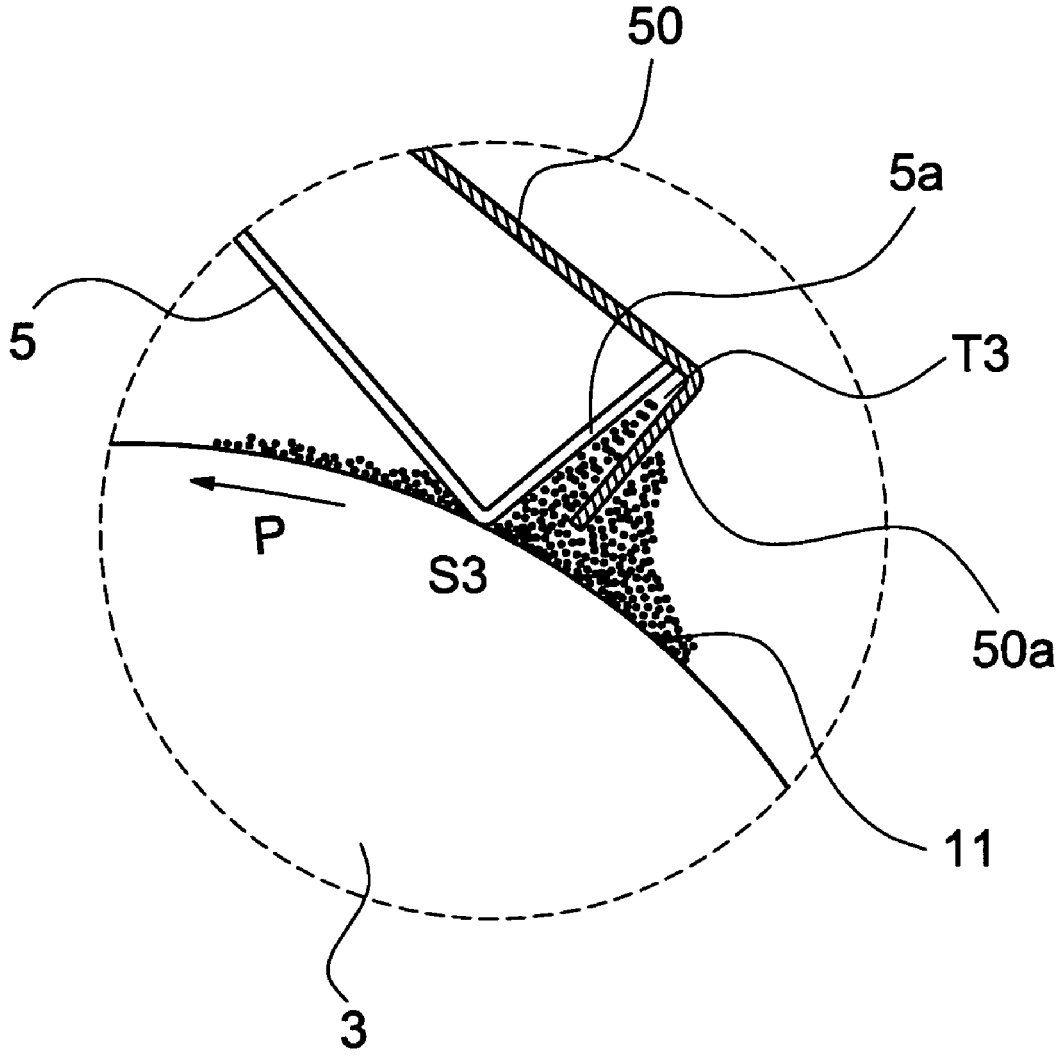
FIG. 14 is a magnified cross section showing a contact part of a developing roller and a developing blade of a developing unit in embodiment 3 of the present invention.

Next is to explain the developing unit in the embodiment 3 of the present invention by using FIGS. 9 and 14.

FIG. 14 is a magnified cross section showing a contact part of a developing roller and a developing blade of a developing unit in embodiment 3 of the present invention.

As stated in embodiment 2, when a driving motor (not shown in drawing) and a power source circuit (not shown in drawing) operates, the developing roller 3 and the providing roller 4 rotate respectively along the arrow directions P and B, then the toner 11 in the toner tank 13 is provided to the developing roller 3 by the providing roller 4. Through the rotation of the developing roller 3, the toner 11 provided to the developing roller 3 reaches a toner layer forming section S3 which is a contact part of the developing roller 3 and the developing blade 5.

On the developing blade 5 provided in the developing unit, the restricting member 50 is provided for restricting the fluidity of the toner 11. Because the space between the bending edge 50*a* of the restricting member 50 and the bending piece 5*a* of the developing blade 5 is provided, the fluidity of the toner 11 drops, and the toner 11 becomes easy to remain in a toner fluidity dropping area T3.

Then, through the developing roller 3 rotates along the arrow direction p, the conveyed toner 11 is saved and the toner fluidity dropping area T2 is full of the toner 11. Because of it, the toner 11 is not be pressed by arrived surplus toner 11 and does not fall off the bending piece 5*a*. The restricting member 40 crosses in the length direction of the developing blade 5, the toner 11 always is in an adhering state along the length. In the case, regardless of the quantity of the toner 11 in the toner tank 13, because the toner 11 always is in an adhering state, it is possible to form a uniform toner layer on the surface of the developing roller 3. Further, because the space between the bending edge 50*a* of the restricting member 50 and the bending piece 5*a* of the developing blade 5 is provided, the adhering quantity of the toner 11 in the toner fluidity dropping area T3 as a toner keeping area can alwayss be kept in a constant, so it is possible to form a more uniform toner layer on the developing roller 3.

Therefore, in the developing unit of the present invention, through the restricting member 50 is provided as covering the tip of the bending piece 5*a* of the developing blade 5, it is possible to sufficiently secure a pressure between the developing roller 3 and the developing blade 5. Then, in the developing unit of the present invention, the fluidity of the toner 11 is dropped, the pressure on the toner layer forming section S3 becomes almost constant in the length direction of the developing blade 5, and the thickness of the layer of the formed toner 11 is stable. As a result, it is possible to obtain a print having high image quality and having no concentration unevenness.

Embodiment 4

Figure 15:
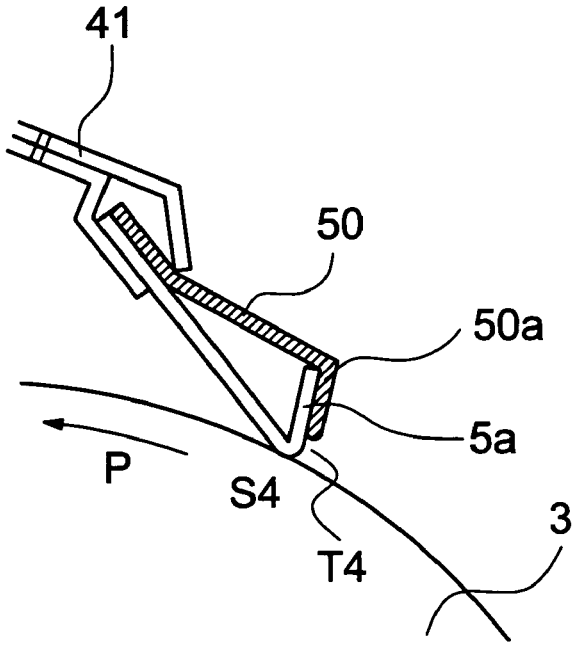
FIG. 15 is a drawing showing a restricting member of a developing unit in embodiment 4 of the present invention.

In embodiment 4, regarding a developing unit having a developing blade 5 provided with a restricting member 50 whose bending edge 50*a* contacts with the bending piece 5*a* of the developing blade 5, it is explained by referring to FIG. 15. Moreover, regarding the same members as that in the embodiment 3, the identical symbol is set, and the corresponding explanation is omitted.

FIG. 15 is a drawing showing a restricting member of a developing unit in embodiment 4 of the present invention.

The restricting member 50, as shown by FIG. 15, has a bending edge 50 with "L" character shape. The bending edge 50*a* is put together with the bending piece 5*a* of the developing blade 5, and contacts with the bending piece 5*a* over the developing roller 3. As stated in the embodiment, the developing blade 5 and the restricting member 50 are sandwiched by the blade holder 41 and are fixed by screws. Thus, a blade having the sandwiched developing blade 5 and the sandwiched restricting member 50 is fixed on the frame 7 as contacting with the developing roller 3 at the bending part of the developing blade 5 in a fixed pressure. Thereby, through a space (i.e. area) formed by the developing roller 3, the bending piece 5*a* and the bending edge 50*a*, a toner fluidity dropping area T4 to drop the fluidity of the toner 11 is formed.

In the embodiment 4, as stated in the embodiment 3, by the developing roller 3 and the bending edge 5*a* of the restricting member 50, the toner fluidity dropping area T4 to drop the fluidity of the toner 11 is formed. Therefore, the fluidity of the toner 11 drops, and the toner 11 becomes easy to remain in a toner fluidity dropping area T4, and it is possible to form a uniform toner layer on the surface of the developing roller 3 in toner layer formation section S4.

Further, because the restricting member 50 covers the upper plane of the developing blade 5, it is possible to prevent the toner 11 from adhering to the upper side of the developing blade 5, and to prevent the toner 11 from flowing to the upper side of the developing blade 5. Therefore, the toner 11 can be effectively used.

Embodiment 5

In embodiment 3, regarding a developing unit having a developing blade whose shape is different from the developing blade 5, in the embodiment 1, it is explained by referring to drawings. Moreover, regarding the same members as that in the embodiment 1, the identical symbol is set, and the corresponding explanation is omitted.

Figure 16:
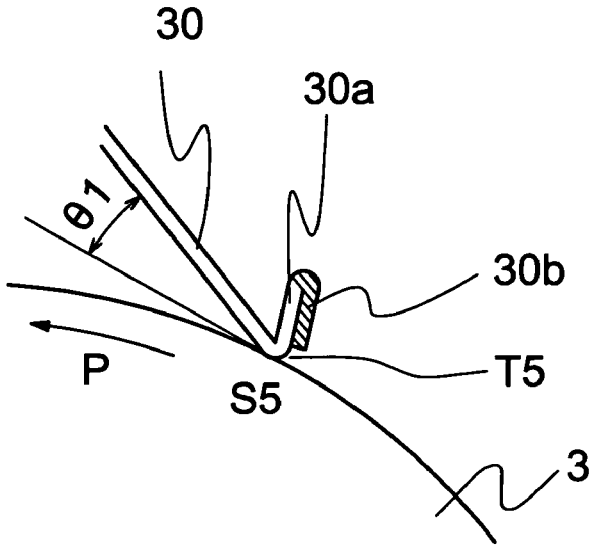
FIG. 16 is a cross section showing shapes of a developing roller and a developing blade of a developing unit in embodiment 5 of the present invention.

FIG. 16 is a cross section showing shapes of a developing roller and a developing blade of a developing unit in embodiment 5 of the present invention.

In the embodiment 5, a developing unit of the present invention includes a photosensitive drum 1 as an image carrying body, a developing roller 3 as developing member, a providing roller 4, a developing blade 30 as developer layer forming member, a blade holder 6, a frame 7, a charging roller 8, a cleaning blade 9, a fixed shaft 10, toner 11 as developer, a toner cartridge 12 as a developer accommodating section, and a toner tank 13.

The developing blade 30 is made from plate shape elastic member having a uniform thickness such as a stainless plate and the like. The developing blade 30 is fixed onto the frame 7 via a blade holder 6, its one end is pressed to the surface of the developing roller 3 at a rotation upstream side of the developing roller 3, in front of the contacting position of the photosensitive drum 1 and the developing roller 3, and a contact angle θ1 is an acute angle with respect to a rotation downstream side of the developing roller 3. The developing blade 30 shaves the toner 11 provided on the surface of the developing roller 3 by the providing roller 4, and controls the thickness of the layer of the toner 11 formed on the surface of the developing roller 3.

In the developing blade 30 pressed to the developing roller 3, as shown by FIG. 16, the one end contacting with the developing roller 3 is bending toward outside of the radial direction of the developing roller 3 as having a "L" character shape, then a bending piece 30*a* is formed on the developing blade 30. Further, the bending piece 30*a* is again bent toward inside of the radial direction of the developing roller 3, then a restricting portion 30*b* is formed. That is, through the developing roller 3, the bending piece 30*a* and the restricting portion 30*b*, a toner fluidity dropping area T5 is formed to drop the fluidity of the toner 11.

Next is to explain the developing unit in the embodiment 5 of the present invention by using FIGS. 16, 17, 18 and 19.

Figure 17:
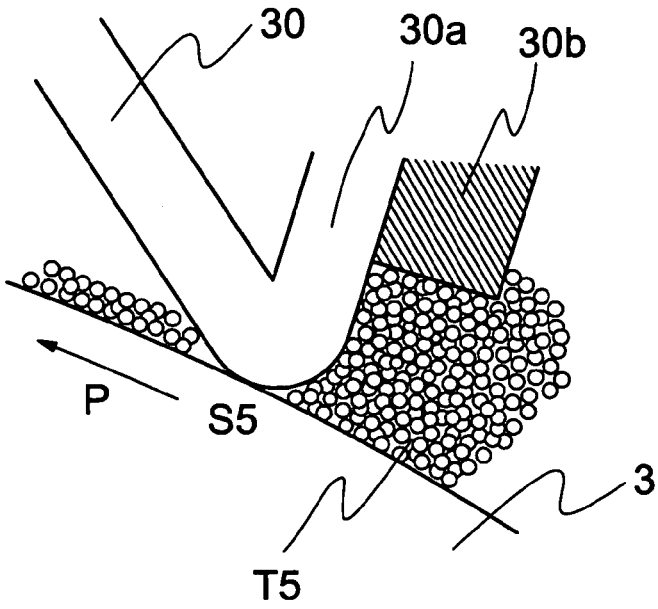
FIG. 17 is a magnified cross section showing a contact part of a developing roller and a developing blade of a developing unit in embodiment 5 of the present invention.
Figure 18:
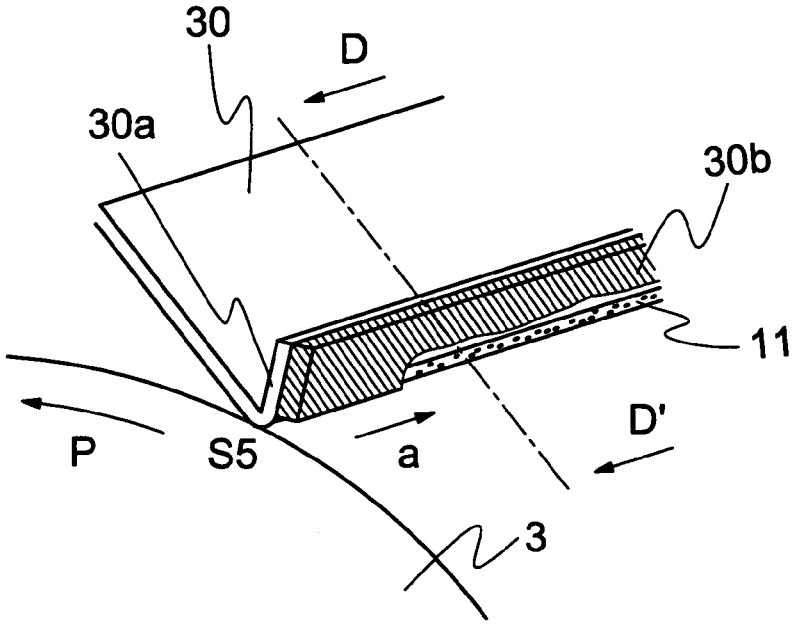
FIG. 18 is a drawing showing a developing roller and a developing blade of a developing unit in embodiment 5 of the present invention.
Figure 19:
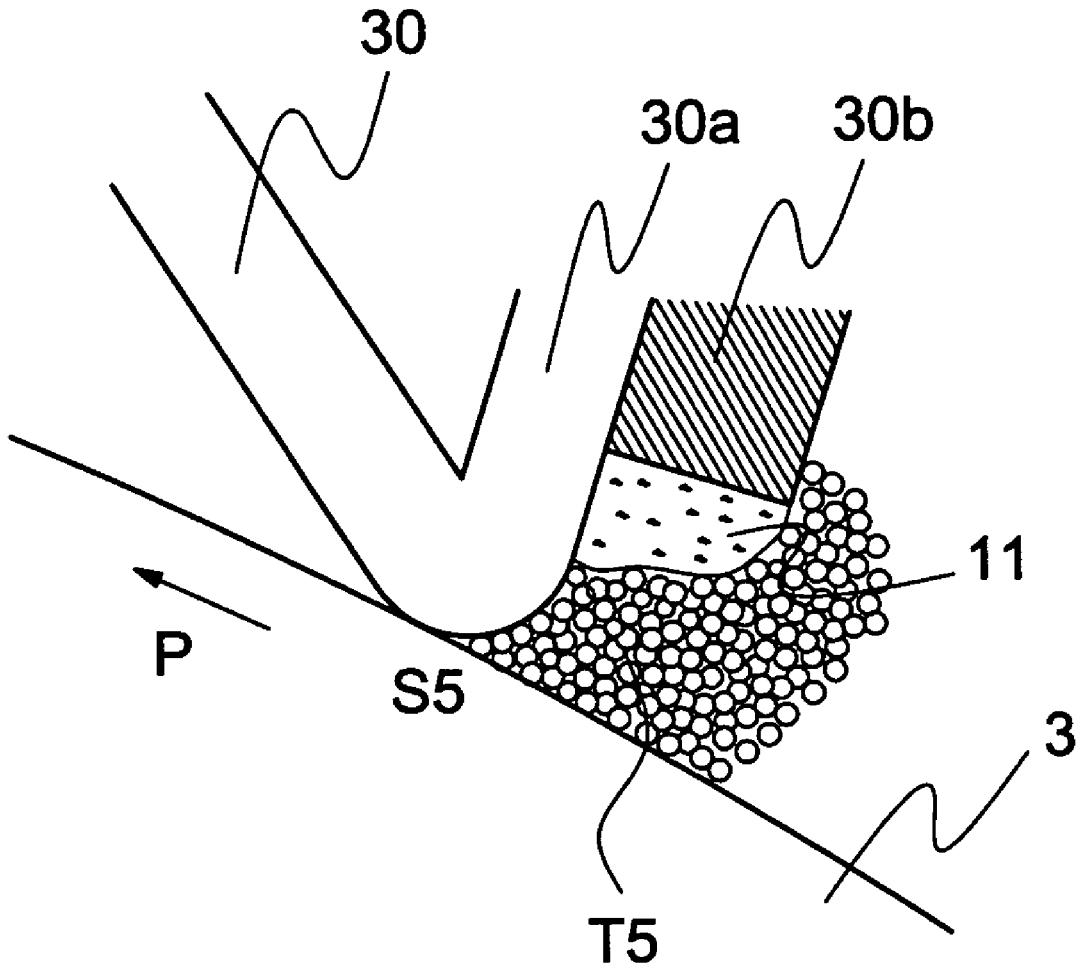

FIG. 17 is a magnified cross section showing a contact part of a developing roller and a developing blade of a developing unit in embodiment 5 of the present invention; FIG. 18 is a drawing showing a developing roller and a developing blade of a developing unit in embodiment 5 of the present invention; and FIG. 19 is a magnified cross section showing D-D' cross section of a developing roller and a developing blade in FIG. 18 from an arrow direction a.

When a driving motor (not shown in drawing) and a power source circuit (not shown in drawing) operates, the developing roller 3 and the providing roller 4 rotate respectively along the arrow directions P and B, then the toner 11 in the toner tank 13 is provided to the developing roller 3 by the providing roller 4. Through the rotation of the developing roller 3, the toner 11 provided to the developing roller 3 reaches a toner layer forming section S5 which is a contact part of the developing roller 3 and the developing blade 30.

On the developing blade 30 provided in the developing unit, the restricting portion 30*b* is provided for restricting the fluidity of the toner 11, then through the restricting portion 30*b* provided to the developing blade 5, the fluidity of the toner 11 drops, and the toner 11 becomes easy to remain in the toner fluidity dropping area T5.

In the toner fluidity dropping area T5, as shown by FIG. 17, a state that it is overflowingly filled with the toner 11 is produced. Therefore, the pressure on the toner layer forming section S5 is almost uniform along the length direction of the developing blade 30, a stable layer of the toner 11 can be formed on the developing roller 3.

Then, a surplus toner 11 shaved by the developing blade 30, as shown by FIG. 18, adheres to the circumference of the toner layer forming section S5 as a contact part of the bending piece 30*a* and the developing roller 3. In the case, as shown by FIG. 19, through the toner 11 un-adhering to the developing blade 30, the toner fluidity dropping area T5 is overflowingly filled with the toner 11 immediately. In this state, because the toner 11 adhering to the developing blade 30 has no place to escape, even if the toner 11 adhering to the developing blade 30 received a force produced by the arriving toner 11, it does not fall off. That is, the pressure on the toner layer forming section S5 is almost uniform along the length direction of the developing blade 30, a stable layer of the toner 11 can be formed on the developing roller 3.

Further, in a state that the toner fluidity dropping area T5 is not full of the toner 11, through a force produced by the toner 11 which has arrived but does not adhere to the developing blade 30, in general, there is a possibility that the toner 11 adhering to the developing blade 30 falls off. In the case, the toner 11 having fallen off the developing blade 30 is left in the toner fluidity dropping area T5 by the restricting portion 30*b* and is used to fill the toner fluidity dropping area T5 together with the toner 11 un-adhering to the developing blade 30. Therefore, in the case, the pressure on the toner layer forming section S5 is also almost uniform along the length direction of the developing blade 30, a stable layer of the toner 11 can also be formed on the developing roller 3.

Moreover, even if the toner 11 adhering to the developing blade 30 is uneven in the length direction of the developing blade 30, as mentioned above, because the restricting portion 30*b* is provided, on any place of the developing blade 30 in the length direction of the developing blade 30, the toner 11 has a identical state in the toner fluidity dropping area T5, so a stable layer of the toner 11 can also be formed on the developing roller 3.

Therefore, in the developing unit of the present invention, because the developing blade 30 is provided with the restricting portion 30*b*, the fluidity of the toner 11 is dropped, the pressure on the toner layer forming section S5 becomes almost constant in the length direction of the developing blade 30, and the thickness of the layer of the formed toner 11 is stable. As a result, it is possible to obtain a print having high image quality and having no concentration unevenness. Further, the restricting portion 30*b* is formed in a unity with the developing blade 30, it is possible to reduce the number of parts and to drop the manufacturing cost.

According to the above stated developing unit of the present invention, it is possible to obtain a stable toner layer having no concentration unevenness on the developing roller 3. In an image forming apparatus comprising the developing unit, it is possible to obtain a print having high image quality and having no concentration unevenness. Regarding the image forming apparatus, it will be explained. A developing section 90 serves as the developing unit stated in the embodiments 1-5, is provided to the image forming apparatus.

Figure 20:
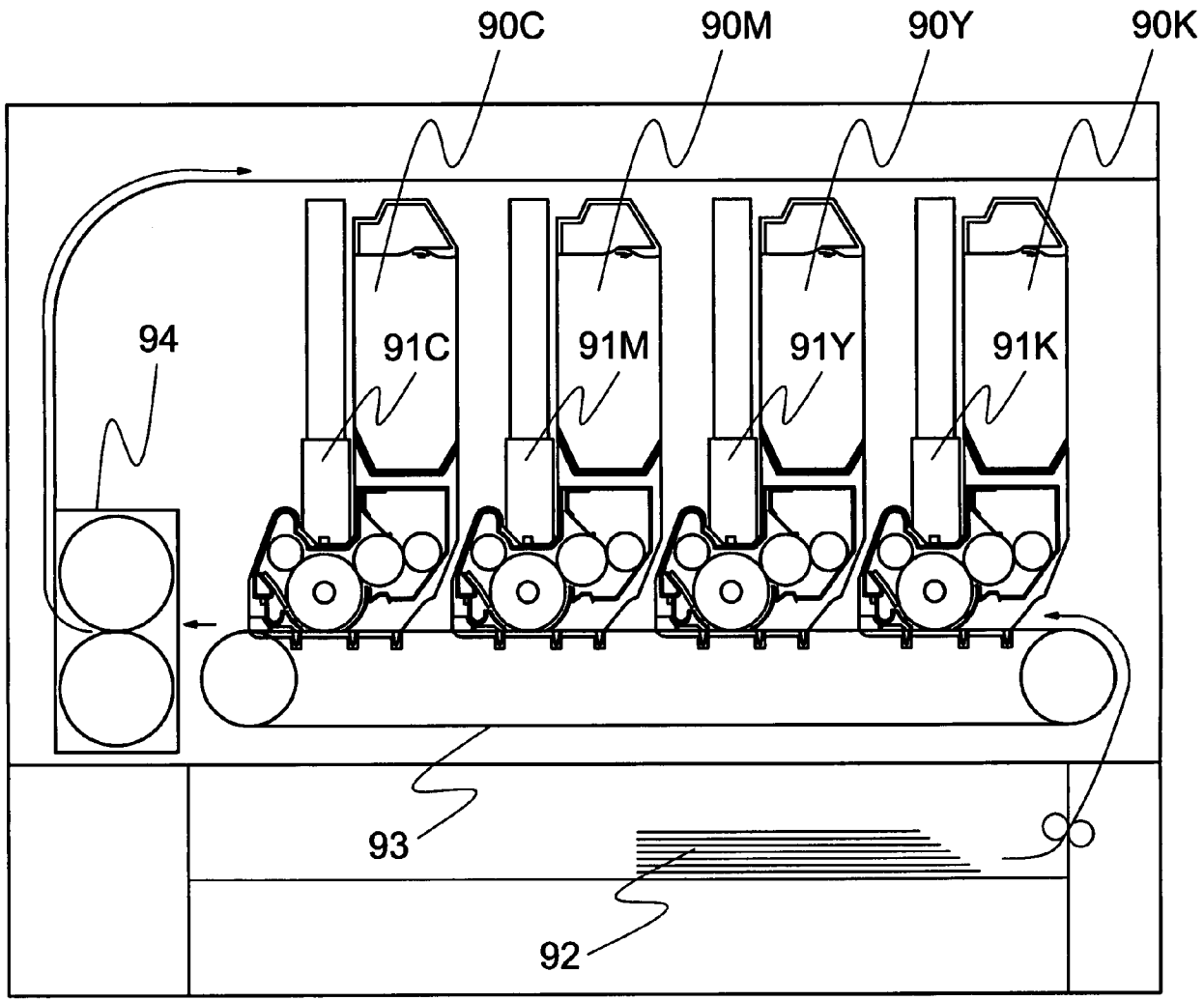
FIG. 20 is a drawing showing a structure of an image forming apparatus of the present invention.

FIG. 20 is a drawing showing a structure of an image forming apparatus of the present invention.

The image forming apparatus of the present invention comprises developing sections 90C, 90M, 90Y, and 90K, exposing sections 91C,91M, 91Y, and 91K, a paper providing tray 92, a conveyance route 93 and a fixing section 94. An arrow in the drawing is used to indicate a route on which the paper is conveyed.

The paper providing tray 92 is a tray to store paper as record medium. On the paper providing tray 92, paper providing roller and the like are installed to convey the paper from the paper providing tray 92 to the conveyance route 93 when to form an image onto the paper as record medium. Through the paper is conveyed from the paper providing tray 92 to the conveyance route 93 by the paper providing roller, the developing section 90 transfers an image onto the paper.

In the developing sections 90, toner cartridges to respectively accommodate color toners of, for example, yellow, magenta, cyan and black, image drums, transferring rollers and the like are provided to correspond to the respective colors. The developing sections 90 are a developing section 90Y, a developing section 90M, a developing section 90C and a developing section 90K to correspond to the respective colors. In the image forming apparatus shown by FIG. 20, the developing section 90K having black toner, the developing section 90Y having yellow toner, the developing section 90M having magenta toner and the developing section 90C having cyan toner are sequentially arranged from the upstream side of the conveyance route 93.

In the image forming apparatus, the exposing sections 91 are provided such as LED heads to correspond to the respective colors. Then, on the respective photosensitive drums 1 of the an electrostatic latent image is formed, and through the developing roller 3, a visible toner image is developed. Then, the toner image on the photosensitive drum 1 is transferred onto the paper.

The paper on which the toner image is transferred is conveyed to the fixing section 94 installed at the downstream side of the conveyance route 93. The fixing section 94 fixes the toner 11 on the paper by heating and pressing. Therefore, the toner 11 on the paper conveyed to the fixing section 94 is fixed by the fixing section 94, and an image is formed on the paper. According to the image forming apparatus, as stated above, a stable toner layer having no concentration unevenness on the developing roller 3 can be obtained, so an image having no concentration unevenness can be formed on the photosensitive drum 1. Because the image having no concentration unevenness is transferred onto the paper, after fixing the image by the fixing section 94, an image having high image quality can be obtained.

The present invention may be applied to apparatus having developing unit, such as copying apparatus, printer, facsimile apparatus, multiple apparatus and the like.

The present invention is not limited to the foregoing embodiments but many modifications and variations are possible within the spirit and scope of the appended claims of the invention.

What is claimed is:

1. A developing unit, comprising:

a developer accommodating section to accommodate developer;

a developing member to provide the developer accommodated in the developer accommodating section to an image carrying body by rotating;

a developer layer forming member which has a contact part to make contact with the developing member, which forms a developer layer on a surface of the developing member, which is made from an elastic member having a plate shape, and which has a bending piece made by bending the elastic member nearby the contact part outwardly toward a radial direction of the developing member; and a restricting member which restricts fluidity of the developer at an upstream side in a rotating direction of the developing member in front of the contact part of the developer layer forming member and the developing member, which is made from an elastic member having a plate shape, which contacts the bending piece of the developer layer forming member, and which extends upwardly to a blade holder at an upper side of the developer layer forming member.

2. The developing unit according to claim 1, wherein the restricting member adheres to the bending piece of the developer layer forming member at the upstream side in a rotating direction of the developing member.

3. The developing unit according to claim 1, wherein the restricting member is formed by bending the elastic member thereof and has a bending edge which faces toward the bending piece of the developer layer forming member thereby defining a space between the bending edge and the bending piece.

4. The developing unit according to claim 3, further comprising a pressing member which presses the restricting member against the developer layer forming member along an upper side of the restricting member.

5. The developing unit according to claim 1, wherein the restricting member is formed by bending the elastic member thereof and has a bending edge positioned to contact the bending piece of the developer layer forming member.

6. The developing unit according to claim 1, further comprising a pressing member which presses the restricting member against the developer layer forming member along an upper side of the restricting member.

7. A developing unit, comprising:

a developer accommodating section to accommodate developer;

a developing member to provide the developer accommodated in the developer accommodating section to an image carrying body by rotating; and a developer layer forming member which has a restricting member to restrict fluidity of the developer while forming a developer layer on a surface of the developing member, which has a contact part to make contact with the developing member, which is made from an elastic member having a plate shape, and which has a bending piece made by bending the elastic member nearby the contact part outwardly toward a radial direction of the developing member, wherein the restricting member of the developer layer forming member is formed by bending the bending piece of the developer layer forming member inwardly toward the radial direction of the developing member.

8. An image forming apparatus, comprising:

an exposing section to expose an image carrying body and to form an electrostatic latent image; and a developing section which forms a developer image by making developer adhere to the electrostatic latent image formed by the exposing section onto an image carrying body, and which comprises:

a developer accommodating section to accommodate developer;

a developing member to provide the developer accommodated in the developer accommodating section to the image carrying body by rotating;

a developer layer forming member which has a contact part to make contact with the developing member, which forms a developer layer on a surface of the developing member, which is made from an elastic member having a plate shape, and which has a bending piece made by bending the elastic member nearby the contact part of the developer layer forming member outwardly toward a radial direction of the developing member; and a restricting member which extends upwardly to a blade holder at an upper side of the developer layer forming member, which contacts the bending piece of the developer layer forming member to restrict fluidity of the developer at an upstream side in a rotating direction of the developing member in front of the contact part of the developer layer forming member and the developing member and which is made from an elastic member having a plate shape.

9. The image forming apparatus according to claim 8, wherein the restricting member adheres to the bending piece of the developer layer forming member at an upstream side in a rotating direction of the developing member.

10. The image forming apparatus according to claim 8, wherein the restricting member is formed by bending the elastic member thereof and has a bending edge which faces toward the bending piece of the developer layer forming member thereby defining a space between the bending edge and the bending piece.

11. The image forming apparatus according to claim 10, further comprising a pressing member which presses the restricting member against the developer layer forming member along an upper side of the restricting member.

12. The image forming apparatus according to claim 8, wherein the restricting member is formed by bending the elastic member thereof and has a bending edge positioned to contact the bending piece of the developer layer forming member.

13. The image forming apparatus according to claim 8, further comprising a pressing member which presses the restricting member against the developer layer forming member along an upper side of the restricting member.

14. An image forming apparatus, comprising:

an exposing section to expose an image carrying body and to form an electrostatic latent image; and a developing section which forms a developer image by making developer adhere to the electrostatic latent image formed by the exposing section onto an image carrying body, and which comprises:

a developer accommodating section to accommodate developer;

a developing member to provide the developer accommodated in the developer accommodating section to the image carrying body by rotating; and a developer layer forming member which has a contact part to make contact with the developing member, which has a restricting member to restrict fluidity of the developer while forming a developer layer on surface of the developing member, which is made from an elastic member having a plate shape, and which has a bending piece made by bending the elastic member nearby the contact part outwardly toward a radial direction of the developing member, wherein the restricting member is formed by bending the bending piece of the developer layer forming member toward the inside of the radial direction of the developing member.

15. A developing unit, comprising:

a developer accommodating section to accommodate developer;

a developing member to provide the developer accommodated in the developer accommodating section to an image carrying body by rotating;

a developer layer forming member for forming a developer layer on a surface of the developing member and having a contact part to make contact with the developing member; and a restricting member to restrict fluidity of the developer at an upstream side in a rotating direction of the developing member in front of the contact part of the developer layer forming member and the developing member, wherein the developer layer forming member (a) is comprised of an elastic member having a board shape one end of which is positioned near to a developing roller, and (b) includes first and second bending portions, the first bending portion being formed by bending the one end of the elastic member toward a radial direction of the developing roller, and the second bending portion being formed by bending the first bending portion toward a converse direction of the radial direction of the developing roller thereby defining a predetermined space between the second bending portion and the developing roller; and wherein the restricting member is made from an elastic member having a plate shape, contacts the bending piece of the developer layer forming member, and extends upwardly to a blade holder at an upper side of the developer layer forming member.

16. An image forming apparatus, comprising:

an exposing section to expose an image carrying body and to form an electrostatic latent image; and a developing section to form a developer image by making developer adhere to the electrostatic latent image formed by the exposing section onto a record medium, wherein the developing section comprises:

a developer accommodating section to accommodate developer;

a developing member to provide the developer accommodated in the developer accommodating section to the image carrying body by rotating;

a developer layer forming member for forming a developer layer on a surface of the developing member and having a contact part to make contact with the developing member; and a restricting member to restrict fluidity of the developer at a upstream side in a rotating direction of the developing member in front of the contact part of the developer layer forming member and the developing member, wherein the developer layer forming member (a) is comprised of an elastic member having a board shape one end of which is positioned near to a developing roller, and (b) includes first and second bending portions, the first bending portion being formed by bending the one end of the elastic member toward a radial direction of the developing roller, and the second bending portion being formed by bending the first bending portion toward a converse direction of the radial direction of the developing roller thereby defining a predetermined space between the second bending portion and the developing roller; and wherein the restricting member is made from an elastic member having a plate shape, contacts with the bending piece of the developer layer forming member, and extends upwardly to a blade holder at an upper side of the developer layer forming member.

* * * * *